US007954420B2

(12) United States Patent
Joergensen et al.

(10) Patent No.: US 7,954,420 B2
(45) Date of Patent: Jun. 7, 2011

(54) HYDRAULIC VALVE ARRANGEMENT

(75) Inventors: Martin Raadkjaer Joergensen, Soenderborg (DK); Ken Petersen, Soenderborg (DK)

(73) Assignee: Sauer-Danfoss Aps, Nordborg (DK)

( * ) Notice: Subject to any disclaimer, the term of this patent is extended or adjusted under 35 U.S.C. 154(b) by 512 days.

(21) Appl. No.: 12/170,056

(22) Filed: Jul. 9, 2008

(65) Prior Publication Data

US 2009/0014074 A1 Jan. 15, 2009

(30) Foreign Application Priority Data

Jul. 12, 2007 (DE) ..... 10 2007 032 415

(51) Int. Cl.
*F15B 13/042* (2006.01)

(52) U.S. Cl. ..... 91/420; 91/464

(58) Field of Classification Search ..... 91/420, 91/437, 464; 137/596.2
See application file for complete search history.

(56) References Cited

U.S. PATENT DOCUMENTS

| | | | | |
|---|---|---|---|---|
| 3,381,587 | A * | 5/1968 | Parquet | 91/420 |
| 3,613,508 | A * | 10/1971 | Krehbiel et al. | 91/420 |
| 3,908,515 | A | 9/1975 | Johnson | |
| 4,034,815 | A * | 7/1977 | Dezelan | 91/437 |
| 4,286,432 | A * | 9/1981 | Burrows et al. | 91/420 |
| 5,036,750 | A | 8/1991 | Katayama | |
| 6,220,289 | B1 | 4/2001 | Zenker et al. | |
| 6,223,773 | B1 * | 5/2001 | Knoell et al. | 137/596.2 |
| 6,293,181 | B1 | 9/2001 | Hajek, Jr. et al. | |
| 6,427,721 | B1 | 8/2002 | Zenker et al. | |
| 6,499,505 | B2 * | 12/2002 | Zenker et al. | 91/420 |
| 6,997,210 | B2 | 2/2006 | Horn et al. | |
| 7,028,710 | B2 | 4/2006 | Joergensen | |
| 2003/0205128 | A1 | 11/2003 | Zenker et al. | |
| 2006/0162544 | A1 | 7/2006 | Loedige et al. | |
| 2006/0201321 | A1 | 9/2006 | Loedige et al. | |

FOREIGN PATENT DOCUMENTS

| | | |
|---|---|---|
| DE | 3322018 | 12/1984 |
| DE | 4028887 | 3/1992 |
| DE | 19919014 A1 | 11/2000 |
| DE | 19919015 A1 | 1/2001 |
| DE | 19931142 A1 | 1/2001 |
| DE | 10138389 A1 | 2/2003 |
| DE | 10224827 A1 | 1/2004 |
| EP | 0129726 A1 | 1/1985 |
| EP | 1281872 A1 | 2/2003 |

* cited by examiner

*Primary Examiner* — Michael Leslie
(74) *Attorney, Agent, or Firm* — McCormick, Paulding & Huber LLP

(57) ABSTRACT

The invention concerns a hydraulic valve arrangement (1) having at least two working connections (A, B), a check valve (5, 6) being allocated to each working connection (A, B), and a pressure relief valve (7, 8) being allocated to each check valve (5, 6), each pressure relief valve (7, 8) being connected to a control pressure passage (17, 18). The valve arrangement shall ensure a reliable, pressure-less lowering, also in connection with single-actuated consumers, and further enable a pressure-less float position. For this purpose, the check valves (5, 6) can be opened by means of tappets (20, 21), whose sides facing away from the check valves (5, 6) are ending in a pressure chamber (22), which is connected to the control pressure passage (17, 18) of one of the pressure relief valves (7, 8).

9 Claims, 1 Drawing Sheet

HYDRAULIC VALVE ARRANGEMENT

CROSS REFERENCE TO RELATED APPLICATIONS

Applicant hereby claims foreign priority benefits under U.S.C. §119 from German Patent Application No. 10 2007 032 415.6 filed on Jul. 12, 2007, the contents of which are incorporated by reference herein.

FIELD OF THE INVENTION

The invention concerns a hydraulic valve arrangement having at least two working connections, a check valve being allocated to each working connection, and a pressure relief valve being allocated to each check valve, each pressure relief valve being connected to a control pressure passage.

BACKGROUND OF THE INVENTION

Such a hydraulic valve arrangement is, for example, known from DE 199 31 142 A1. Therein, one of the working connections is pressurised by means of a pressure medium and a common control valve, while the other working connection is relieved to a tank. In order to open the check valve of the working connection relieved to the tank, the pressure relief valve allocated to this check valve is subjected to a control pressure. This causes the check valve to be held in the closed position merely by the pressure of a spring, so that a small pressure increase at the working connection is sufficient to open the check valve.

In a float position of the control valve, both pressure relief valves are subjected to a control pressure, so that both working connections are relieved to the tank.

Such hydraulic valve arrangements are, for example, used with working vehicles that can be provided with working attachments. Attachments are, for example, snow clearance or street cleaning devices, but also agricultural devices.

Thus, such vehicles can be provided with different attachments. It is possible to connect both double-actuated consumers and single-actuated consumers. Consumers are, for example, single-acting or double-acting lifting mechanisms—so called hitches. With double-actuated hitches, a pressure medium actuates both the raising and the lowering movement. In this configuration the pressure increase occurring at the passive working connection of a hydraulic valve arrangement as described in the introduction will be sufficient to open the corresponding check valve.

With single-actuated hitches, in which a lift cylinder is pressurised by means of a pressure medium only during the raising movement, and the lowering movement is caused merely by the dead weight of the connected attachment, the weight of the connected attachment must be sufficient to provide a pressure increase that ensures the opening of the corresponding check valve. With light-weight attachments, it may happen that the pressure increase generated by gravity is not sufficient to open the check valve.

DE 102 24 827 A1 discloses a hydraulic valve arrangement with two working connections, a check valve being allocated to each working connection. A tappet is arranged between the valve elements of the two check valves, said tappet being subjected to pressure during the activation of one of the working connections in such a manner that it moves in the direction of the check valve of the other working connection, thus opening this check valve. This causes a direct relief to tank of the working connection that is not pressurised by a pressure medium. Thus, a reliable lowering is also ensured with single-acting hitches with light-weight attachments. However, with this valve arrangement it is not possible to assume a pressure-less float position, in which both check valves are open. A float position is for example advantageous, if the hitch has to be moved by external forces, which is, for example, the case, if an attachment has to follow the ground.

U.S. Pat. No. 3,908,515 discloses a hydraulic valve arrangement, in which a float position is enabled in that two tappets are arranged between the check valves, the tappet sides which face away from the check valves ending in a common pressure chamber. When the pressure chamber is pressurised, the two tappets are pressed away from each other and the check valves are opened. However, the pressurisation of the pressure chamber between the two tappets requires an additional valve arrangement, which increases the space requirement and the manufacturing costs. At the same time, the reliability of the valve arrangement is reduced.

SUMMARY OF THE INVENTION

The invention is based on the task of providing a hydraulic valve arrangement, which ensures a reliable, pressure-less lowering also of a single-actuated consumer and enables a pressure-less float position.

With a hydraulic valve arrangement as mentioned in the introduction, this task is solved in accordance with the invention in that the check valves can be opened by means of tappets, whose sides facing away from the check valves are ending in a pressure chamber, which is connected to the control pressure passage of one of the pressure relief valves.

Such a configuration enables a reliable opening of the check valves without requiring additional valves. This results in a compact valve arrangement that functions reliably both with single-actuated consumers and with double-actuated consumers. In the float position, the pressure relief valves are pressurised by means of a pressure medium. As this will also cause the pressure chamber for the tappets to be pressurised by means of the pressure medium, the tappets are pressed away from each other, and the check valves, which have already been relieved through the pressure relief valves, will be reliably opened. A connected consumer can then be moved under the influence of small forces, as only frictional forces remain to be overcome. Also with light-weight consumers this ensures a reliable lowering. The connection of the pressure chamber to the control pressure passage of one of the pressure relief valves can, in a manner of speaking, also be realised indirectly through a valve, this connection being, under certain circumstances, interrupted from time to time by the valve.

Preferably, the pressure chamber is connected to the control pressure passage that is pressure relieved during raising. This is the control pressure passage connected to the pressure relief valve, which is pressurised by means of the pressure medium during lowering. During raising, this control passage is then pressure relieved. Thus, it is prevented that the check valve, which will be opened during raising by the pressure medium flowing to the working connection, will be opened by the tappet alone. Thus, a short lowering of a heavy load before the raising is prevented. This lowering could be caused by the check valve already being opened, before the pump has built up a sufficient pressure.

Preferably, the hydraulic valve arrangement has a control valve, which is arranged between a supply connection arrangement and the working connections. The supply connection arrangement can, for example, have a high-pressure and a low-pressure connection, the control valve establishing a connection between the supply connection arrangement and the working connections. With a suitable embodiment of the control valve, the control pressure will always pressurise the particular pressure relief valve, which is allocated to the check valve that is allocated to the particular working connection that is not pressurised by means of the pressure medium. The connection of the pressure chamber to the control pressure passage of one of the pressure relief valves can then also take place via this control valve, and the pressure chamber can be connected to the control valve via a passage in parallel to one of the pressure relief valves.

Preferably, the control valve is connected to the check valves via working passages and to the pressure relief valves via the control pressure passages. Thus, all the valves are connected to a common control valve. The connection of the hydraulic valve arrangement to the supply connection arrangement thus only takes place via the control valve. This makes the mounting of the valve arrangement correspondingly simple.

Preferably, the pressure in the control pressure passages depends on the position of the control valve. This results in an automatic control of the corresponding pressure relief valves in dependence of, which of the working connections is momentarily pressurised by the pressure medium. Thus, erroneous operation is avoided.

Preferably, a mechanical contact between the tappets exists, when the pressure chamber is pressure-less. Thus, the tappets can have an immediate influence on each other.

Preferably, the side of the tappets facing the check valve is subjected to the pressure in the corresponding working passage. Thus, the tappet is displaced in the direction of the other check valve, so that it also moves the other tappet. This tappet then opens the check valve in the working passage that is not pressurised by means of the pressure medium. Thus, a reliable opening of this check valve is ensured.

It is particularly preferred that the tappets and the valve elements of the check valves have a common movement axis. This is a particularly simple arrangement of these elements. The movement of the tappets can then be transferred to the valve elements without requiring any deflection arrangements or gears, which yields an operation with only small losses.

Preferably, the check valves can be acted upon in the closing direction by a spring and a reduced load pressure and in the opening direction by the tappets and the load pressure. For the reduction of the load pressure, a throttle is provided. The reduction occurs in such a way that the sum of the spring force and the reduced load pressure will be sufficient to hold the check valve in the closed position also with a high load pressure. With such a device a reliable holding of a consumer is ensured without requiring a pressure medium to pressurise the working passages. An opening of the check valve then occurs by a movement of the tappet and/or by a pressure relief by means of the pressure relief valve. The pressure relief valves and the throttles ensure a reliable opening of the check valves, also with a high load pressure. If a high load pressure is present at one of the working connections, the position of the corresponding check valve is mainly determined by the pressure balance of the load pressure before the throttle and the reduced load pressure after the throttle. Opening the corresponding pressure relief valve causes a reduction of the reduced load pressure after the throttle. Usually, the pressure relief valve will have a larger flow opening than the throttle, so that the pressure after the throttle drops towards zero. Thus, only the force of the spring counteracts the load pressure acting upon the check valve in the opening direction. If the load pressure itself is not sufficient to open the check valve, the tappet must only act upon the check valve with a little force in order to open it. Thus, the opening of the check valves is also ensured with a high load pressure.

BRIEF DESCRIPTION OF THE DRAWINGS

In the following, the invention is described in detail on the basis of a preferred embodiment in connection with the drawing, showing.

DETAILED DESCRIPTION

Figure 1:
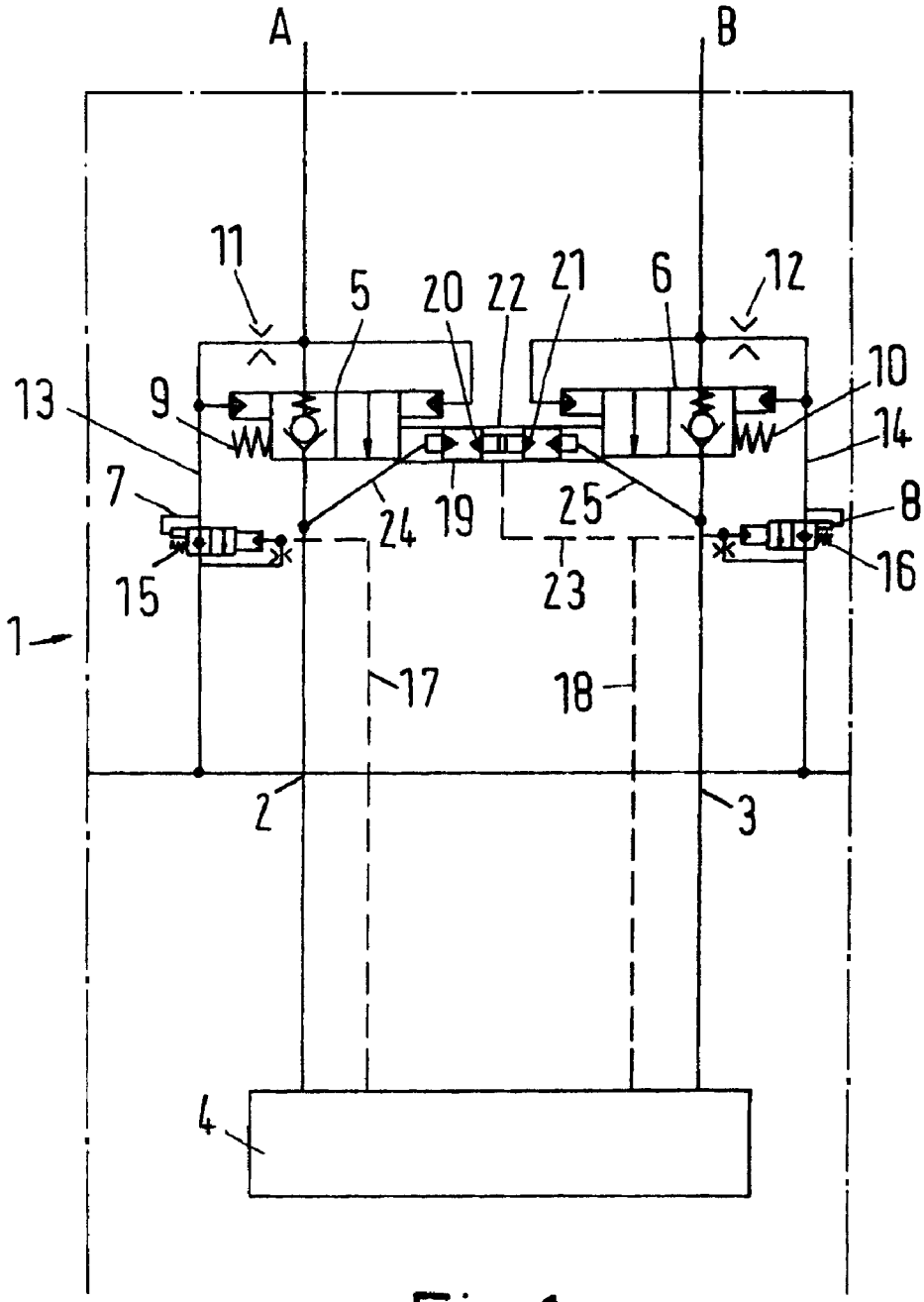
FIG. 1 is a schematic diagram of an embodiment of the valve arrangement according to the invention.

A hydraulic valve arrangement 1 has a working connection arrangement with two working connections A and B, which are connected via working passages 2 and 3 to a control valve 4. In each working passage 2, 3 is arranged a check valve 5, 6, between the working connection A, B and the control valve 4. A pressure relief valve 7, 8 is allocated to each check valve 5, 6. In this embodiment, the working connection B is dedicated to raising, that is, a pressure is built up at the working connection B for the raising of a load.

In the closing direction, each check valve 5, 6 is acted upon by a spring 9, 10, which can be arranged in a spring chamber. With this embodiment, also the pressure in a pressure chamber acts upon the check valve in the closing direction, the pressure chambers being connected to the corresponding working connections A, B via throttles 11, 12 and to the corresponding pressure relief valves 7, 8 via relief passages 13, 14. The pressure chamber and the spring chamber can also be the same chamber.

Each pressure relief valve 7, 8 is biased in the closing direction by a spring 15, 16 and the pressure in the relief passage 13, 14. For opening, the pressure relief valves 7, 8 are subjected to a pressure via control pressure passages 17, 18. When the pressure relief valve 7, 8 is open, the corresponding relief passage 13, 14 is pressure-less, so that in the closing direction the corresponding check valve 5, 6 is only acted upon by the pressure of the spring 9, 10.

Two tappets 20, 21 are arranged in a tappet bore 19 between the check valves 5, 6, the side of each tappet 20, 21 which faces away from the corresponding check valve 5, 6 ending in a pressure chamber 22. Via a passage 23, the pressure chamber 22 is connected to the control pressure passage 18 of the pressure relief valve 8. At the ends facing the corresponding check valves 5, 6, the tappets can be subjected to pressure via the tappet channels 24, 25. The tappet channels 24, 25 are connected to the corresponding working passages 2, 3. For example, pressurising the working passage 2 will subject the tappet 20 to pressure through the tappet channel 24, so that the tappets 20, 21 will move to the right of the drawing, thus opening the check valve 6. Pressurising the working passage 3 will cause a reversed pressure activation and movement of the tappets 20, 21, so that the check valve 5 is opened.

In a neutral position of the control valve 4, the working passages 2, 3 and the control pressure passages 17, 18 are relieved. Thus, also the tappet channels 24, 25 are pressure-less. This causes both check valves 5, 6 to be in the closed position, so that a backflow of pressure medium from the working connections A, B is prevented.

For example, for the raising of a consumer connected to the working connections A, B, the control valve 4 is moved to a position "raise". This will relieve the working passage 2 to tank, whereas the working passage 3 is pressurised by means of the pressure medium. At the same time, the control pressure passage 17 is subjected to a control pressure. The control pressure passage 18, and thus also the pressure chamber 22, is relieved. The pressure in the working passage 3 causes the check valve 6 to open, so that pressure medium gets to the working connection B. As the pressure chamber 22 is relieved via the control pressure passage 18, the tappet 21 applies no force on the check valve 6. Thus, the check valve 6 will not be opened until the pressure in the working passage 3 exceeds the load pressure at the working connection B. A brief lowering of a heavy load is thus prevented. Of course, in this situation the working passage 2 should be pressure-less, as the pressure in the working passage 2 is transferred via the tappet channel 24 to the tappet 20, which would then be displaced together with the tappet 21 in the direction of the check valve 6, thus opening it. The pressure relief of the working passage 2 during a pressure activation of the working passage 3 is ensured via the control valve 4.

The pressure in the working passage 3 is at the same time transferred via the tappet channel 25 to the tappet 21, which moves the tappets 20, 21 in the direction of the check valve 5, thus opening it. The opening of the check valve 5 is supported by the pressure of the pressure medium flowing back from the working connection A. The opening of the check valve 5 is also facilitated in that the pressure relief valve 7 is subjected to pressure via the control pressure passage 17 and thus is opened. This permits the pressure medium to get from the working connection A through the check valve 5, the working passage 2 and the control valve 4 to a supply connection arrangement (not shown) without significant pressure losses.

To lower the consumer, the control valve 4 is moved to the position "lower". The working passage 3 is relieved and the working passage 2 is pressurised by means of the pressure medium. This opens the check valve 5, so that the pressure medium gets to the working connection A and thus to the consumer. The pressurising of the working passage 2 causes that also the tappet 20 is subjected to a pressure via the tappet channel 24, so that the tappets 20, 21 move in the direction of the check valve 6.

When the control valve 4 is in the position "lower", the control pressure passage 18 is subjected to a control pressure. This opens the pressure relief valve 8, and the relief passage 14 is relieved. The check valve 6 is now moved into the open position by the tappets 20, 21 in conjunction with the pressure of the pressure medium flowing back through the working connection B, against the force of the spring 10 only. As the relief passage 14 is relieved via the pressure relief valve 8, the opening of the check valve 6 is possible without problems, also with a large load. In this case, the flow opening of the pressure relief valve 8 is larger than the cross-section of the throttle 12, so that the relief passage 14 is practically pressure-less.

With a small load, that is, a small load pressure at the working connection B, it may happen that the load pressure is not sufficient to open the check valve 6 against the force of the spring 10. The check valve 6 is then reliably opened by the tappet 21, which is acted upon in the direction of the check valve 6 by the pressure in the pressure chamber 22. The pressure in the pressure chamber 22 is the same as the pressure in the control passage 18, as the pressure chamber 22 is connected to the control pressure passage 18 via the passage 23. The control pressure passage 18 is subjected to pressure anyway, as also the pressure relief valve 8 has to be opened during lowering. The spring 10 is dimensioned so that the force of the tappet 21 acting upon the check valve 6 is sufficient to open the check valve 6.

The pressure chamber 22 between the tappets 20, 21 is also pressurised via the control pressure passage 18 and the passage 23. As, however, both check valves 5, 6 are already in the open position, this is not disturbing.

With a single-actuated consumer, the working connection A is, for example, closed by means of a locking plug. Then the check valve 5 has no function, and does not have to, but can of course still, be activated. During lowering, pressurising of the working passage 2 can be omitted.

If the valve arrangement is connected to a pump with automatic load compensation, the closing of the working connection A could during lowering of the load cause the pump to increase the supply pressure, as in this situation it can only supply very little pressure medium to the working passage 2. In order to prevent this, it is possible, in connection with single-acting operation, for example to automatically relieve the load passage of the pump to the tank during lowering. This additional function is not shown in FIG. 1. It can easily be integrated in the valve arrangement and be activated by a manual switching function. The switching of the valve arrangement from double-acting (so-called 4/4) to single-acting (so-called 3/4) operation can easily be realised when mounting the valve arrangement on a vehicle.

A reliable opening of the check valve 6 is then ensured by the pressure in the control pressure passage 18, by which firstly the pressure relief valve 8 is opened and secondly the pressure chamber 22 is pressurised via the passage 23. This displaces the tappet 21 in the direction of the check valve 6, so that the check valve 6 opens. This enables a reliable lowering, even when no pressure is available at the working connection A. The pressure chamber 22 should be connected to the control pressure passage 18, which is pressure-less during raising, of the pressure relief valve 8, which is allocated to the working connection B that is pressurised by means of the pressure medium during raising.

If a connected consumer is to be moved by external forces, the control valve 4 is moved to a "float" position. In this position both working passages 2, 3 are relieved. At the same time, the control pressure passages 17, 18 are pressurised by means of the pressure medium. This opens the pressure relief valves 7, 8. Via the passage 23, the control pressure is also present in the pressure chamber 22 between the two tappets 20, 21. Consequently, the two tappets 20, 21 are pressed apart and thus open the check valves 5, 6. This permits a free movement of the connected consumer.

In this embodiment, all valves are made as seated valves, and not as slide valves, among other things to ensure the tightness of the valve arrangement. This results in pressure loads at the valve elements, shown for each valve in FIG. 1 as pressure chambers on both sides of the valve slide. These pressure loads have to be considered when dimensioning the valve arrangement.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A hydraulic valve arrangement having at least two working connections, a check valve being allocated to each working connection, and a pressure relief valve being allocated to each check valve, each pressure relief valve being connected to a control pressure passage, wherein the check valves can be opened by means of tappets, whose sides facing away from the check valves are ending in a pressure chamber, which is connected to the control pressure passage of one of the pressure relief valves.

2. The hydraulic valve arrangement according to claim 1, wherein the pressure chamber is connected to the control pressure passage that is pressure relieved during raising.

3. The hydraulic valve arrangement according to claim 1, wherein the hydraulic valve arrangement has a control valve, which is arranged between a supply connection arrangement and the working connections.

4. The hydraulic valve arrangement according to claim 3, wherein the control valve is connected to the check valves via working passages and to the pressure relief valves via the control pressure passages.

5. The hydraulic valve arrangement according to claim 1, wherein the pressure in the control pressure passages depends on the position of the control valve.

6. The hydraulic valve arrangement according to claim 1, wherein a mechanical contact between the tappets exists, when the pressure chamber is pressure-less.

7. The hydraulic valve arrangement according to claim 1, wherein the side of each tappet facing the check valve is acted upon by the pressure in the corresponding working passage.

8. The hydraulic valve arrangement according to claim 1, wherein the tappets and the valve elements of the check valves have a common movement axis.

9. The hydraulic valve arrangement according to claim 1, wherein the check valves can be acted upon in the closing direction by a spring and a reduced load pressure and in the opening direction by the tappets and the load pressure.

* * * * *